US009793081B2

(12) United States Patent
Sun et al.

(10) Patent No.: US 9,793,081 B2
(45) Date of Patent: Oct. 17, 2017

(54) EXCHANGE OPERATING MECHANISM

(71) Applicants: SEARI ELECTRIC TECHNOLOGY CO., LTD., Shanghai (CN); ZHEJIANG CHINT ELECTRICS CO., LTD., Yueqing (CN)

(72) Inventors: Jisheng Sun, Shanghai (CN); Zheng Shi, Shanghai (CN); Binhua Pan, Shanghai (CN)

(73) Assignees: Seari Electric Technology Co., LTD., Shanghai (CN); Zhejhiang Ching Electronics Co., LTD., Yueqing (CN)

( * ) Notice: Subject to any disclaimer, the term of this patent is extended or adjusted under 35 U.S.C. 154(b) by 0 days.

(21) Appl. No.: 15/024,320

(22) PCT Filed: Sep. 19, 2014

(86) PCT No.: PCT/CN2014/086923
§ 371 (c)(1),
(2) Date: Mar. 23, 2016

(87) PCT Pub. No.: WO2015/043425
PCT Pub. Date: Apr. 2, 2015

(65) Prior Publication Data

US 2016/0268088 A1 Sep. 15, 2016

(30) Foreign Application Priority Data

Sep. 24, 2013 (CN) ..... 2013 1 0442315

(51) Int. Cl.
*H01H 3/04* (2006.01)
*H01H 3/20* (2006.01)
(Continued)

(52) U.S. Cl.
CPC .... *H01H 71/1009* (2013.01); *H01H 11/0018* (2013.01); *H01H 21/22* (2013.01);
(Continued)

(58) Field of Classification Search
CPC .... H01H 71/1009; H01H 21/22; H01H 71/10; H01H 2205/002; H01H 1/00; H01H 1/12;
(Continued)

(56) References Cited

U.S. PATENT DOCUMENTS 3,286,067 A * 11/1966 Menickella ..... H01H 73/04 200/244
5,260,533 A 11/1993 Livesey et al.
(Continued)

FOREIGN PATENT DOCUMENTS

CN 1830049 A 9/2006
CN 101176176 A 5/2008
(Continued)

OTHER PUBLICATIONS

International Search Report issued in PCT/CN2014/086923 dated Dec. 23, 2014 (2 pages).
(Continued)

*Primary Examiner* — Anthony R. Jimenez
(74) *Attorney, Agent, or Firm* — Osha Liang LLP

(57) ABSTRACT

A changeable mechanism includes a contact support, a connecting rod, a connecting shaft, a cantilever, and a changeable component. The contact support has a moving contact therein, and rotates about a shaft. The connecting rod bottom end is connected to the contact support, the connecting rod top end is connected to a cantilever through a connecting shaft. The changeable component is connected to and drives the cantilever through a main shaft, and drives the contact support to rotate through the connecting shaft and connecting rod. Rotation of the contact support makes the moving contact and static contact separate or in contact to realize opening or closing a circuit breaker. The changeable mechanism may switch between a manual operation mechanism and an electrical operation mechanism of a MCB. The
(Continued)

changeable component does not dispose the electrical operation mechanism outside the MCB, so that height and volume of the MCB is reduced.

17 Claims, 7 Drawing Sheets

(51) Int. Cl.

| | |
|---|---|
| ***H01H 71/10*** | (2006.01) |
| ***H01H 21/22*** | (2006.01) |
| ***H01H 71/52*** | (2006.01) |
| ***H01H 11/00*** | (2006.01) |
| *H01H 71/58* | (2006.01) |

(52) U.S. Cl.
CPC ..... *H01H 71/10* (2013.01); *H01H 71/1027* (2013.01); *H01H 71/526* (2013.01); *H01H 71/528* (2013.01); *H01H 71/58* (2013.01); *H01H 2205/002* (2013.01)

(58) Field of Classification Search
CPC .. H01H 1/14; H01H 1/22; H01H 1/50; H01H 3/00; H01H 3/04; H01H 3/32; H01H 3/42; H01H 9/20; H01H 9/24; H01H 2205/00
USPC ..... 200/19.18, 19.2, 19.21, 19.22, 19.27, 200/19.3, 50.01, 51 R, 400, 410, 415, 200/431, 335–338
See application file for complete search history.

(56) References Cited

U.S. PATENT DOCUMENTS

| | | | | |
|---|---|---|---|---|
| 5,449,871 | A * | 9/1995 | Batteux ..... | H01H 71/501 200/401 |
| 6,423,917 | B2 * | 7/2002 | Narayanan ..... | H01H 71/70 200/400 |
| 2002/0153238 | A1 | 10/2002 | Baldauf et al. | |
| 2011/0272259 | A1 | 11/2011 | Scola et al. | |

FOREIGN PATENT DOCUMENTS

| | | | |
|---|---|---|---|
| CN | 201898099 | U | 7/2011 |
| DE | 2012544 | A1 | 9/1971 |
| EP | 1130614 | A1 | 9/2001 |
| JP | H09198984 | A | 7/1997 |
| KR | 20090006680 | A | 1/2009 |
| WO | 03052784 | A1 | 6/2003 |
| WO | 2005031779 | A1 | 4/2005 |

OTHER PUBLICATIONS

Written Opinion of the International Searching Authority issued in PCT/CN2014/086923 dated Dec. 23, 2014 (3 pages).
Chinese First Office Action in corresponding Application No. 201310442315.7 dated Feb. 2, 2016, with English translation of the Search Report contained therein (7 pages).
Extended European Search Report issued in corresponding European Application No. 14849068.3 dated Apr. 7, 2017 (8 pages).

* cited by examiner

EXCHANGE OPERATING MECHANISM

BACKGROUND OF THE INVENTION

1. Field of the Invention

The present invention relates to circuit breakers, more particularly, relates to a changeable operation mechanism of a circuit breaker.

2. The Related Art

Circuit Breakers are common equipments among low-voltage electrical devices. Circuit breakers include Molded case Circuit Breakers (MCBs) and Air Circuit Breakers (ACBs). Generally, MCBs use manual operation mechanisms and do not have remote operation ability. When remote operation is required, an additional electrical operation mechanism shall be installed to the MCB, the electrical operation mechanism includes an energy storage mechanism and an energy storage motor. Such an electrical operation mechanism is usually installed outside the body of the MCB, so that the height and volume of the MCB is increased. The additional electrical operation mechanism increases the cost of the MCB as well. ACBs usually use electrical operation mechanisms as internal components. The electrical operation mechanism is installed within the shell of the ACB, which will not increase the height and volume of the ACB. The entire cost of ACB is also lower than the cost of a sum of the MCB and the additional electrical operation mechanism.

In actual applications, it is often required that the circuit breakers have both manual operation function and electrical operation function. Therefore, ACBs which only have the electrical operation mechanism are not applicable because ACBs are not able to have the manual operation function. For MCBs, an additional electrical operation is required when the electrical operation function is necessary, which is an obvious disadvantage in usage convenience and usage cost.

SUMMARY

The present invention provides a changeable mechanism that is applicable for MCBs. The changeable mechanism allows MCBs to realize convenient change between a manual operation mechanism and an electrical operation mechanism, so as to enhance the usage convenience while reduce the usage cost.

According to an embodiment of the present invention, a changeable mechanism is provided, the changeable mechanism comprises a contact support, a connecting rod, a connecting shaft, a cantilever and a changeable component. The contact support is provided with a moving contact therein, the contact support rotates about a shaft to make the moving contact be separated from or in contact with a static contact. The bottom end of the connecting rod is connected to the contact support, the top end of the connecting rod is connected to a cantilever through a connecting shaft. The changeable component is connected to the cantilever through a main shaft, the changeable component acts and drives the cantilever to act through the main shaft, and further drives the contact support to rotate through the connecting shaft and the connecting rod. The rotation of the contact support makes the moving contact and the static contact to be separated from or in contact with each other so as to realize opening or closing of a circuit breaker. The changeable component is a manual operation mechanism or an energy storage mechanism.

In one embodiment, the connecting rod has a dual-plate structure, two plates are connected to each other and has a gap therebetween. The two plates have same shape and same size. Each plate has a rod hole in the bottom, a shaft passes through the rod holes so that the connecting rod is rotatably connected to the contact support 102. On the top of each plate, there is a chute and a circular hole, the chute is connected with the circular hole and the chute extends to the edge of the top end of the plate. The width of the chute is smaller than the diameter of the circular hole.

In one embodiment, the connecting shaft is composed of a square bar in the middle and two obround bars on both sides of the square bar. The cross-section of the obround bar is obround. The width of the obround bar matches with the width of the chute. The length of the obround bar matches with the diameter of the circular hole, and the arc surfaces on both ends of the obround bar match with the circular hole. The width of the square bar matches with the width of the gap between the two plates of the connecting rod.

In one embodiment, the top end of the connecting rod is connected to the connecting shaft, the connecting shaft rotates to make the obround bars on both sides be parallel to the chute and slide along the chute into the circular holes. The connecting shaft rotates to make the obround bars be not parallel to the chute and the obround bars are mounted within the circular holes and are able to rotate therein.

In one embodiment, the cantilever is provided with a square groove in the bottom, and a main shaft hole on the top. The shape and size of the square groove match with the shape and size of the square bar of the connecting shaft. The square bar is secured in the square groove so that the connecting shaft is connected to the cantilever. The thickness of the cantilever equals to the thickness of the square bar. The connecting shaft is connected to the connecting rod. The cantilever and the square bar are embedded into the gap between two plates of the connecting rod.

In one embodiment, contact support rotates to make the moving contact and the static contact be separated from or in contact with each other. The obround bar of the connecting shaft rotates within the circular hole, the rotation range of the obround bar does not include positions that will make the obround bar be parallel to the chute.

In one embodiment, an action stroke of the cantilever driven by the manual operation mechanism through the main shaft, and an action stroke of the cantilever driven by the energy storage mechanism (112) through the main shaft are the same.

In one embodiment, the manual operation mechanism or the energy storage mechanism are mounted on a middle shell of a circuit breaker base. When the changeable component is the energy storage mechanism, an energy storage motor is mounted on the circuit breaker base and is disposed on the same side as the energy storage mechanism.

The changeable operation mechanism of the present invention may realize a convenient switch between a manual operation mechanism and an electrical operation mechanism of a MCB. When a MCB is applied in different applications, its operation mechanism may be changed between a manual operation mechanism and an electrical operation mechanism. The changeable component does not dispose the electrical operation mechanism outside the MCB, so that the height and volume of the MCB is reduced.

BRIEF DESCRIPTION OF THE DRAWINGS

The above and other features, natures, and advantages of the invention will be apparent by the following description of the embodiments incorporating the drawings, wherein.

DETAILED DESCRIPTION OF EMBODIMENTS

The present invention discloses a changeable operation mechanism, the operation mechanism is able to switch between a manual operation mechanism and an energy storage mechanism (i.e. an electrical operation mechanism). The changeable operation mechanism may be applied to Moulded Case Circuit Breakers (MCBs). The changeable operation mechanism may significantly enhance the usage convenience of the MCBs while keeping the MCBs in small volume and low cost.

Figure 1:
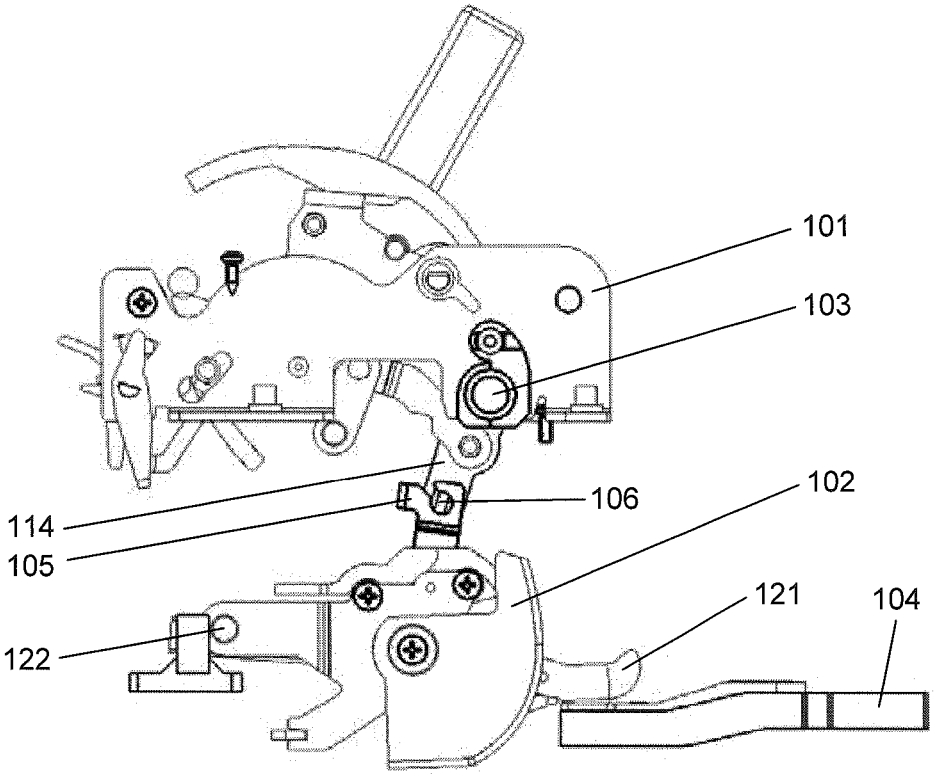
FIG. 1 illustrates the structure of a changeable operation mechanism according to an embodiment of the present invention, wherein the manual operation mechanism is used and is in a close state.
Figure 2:
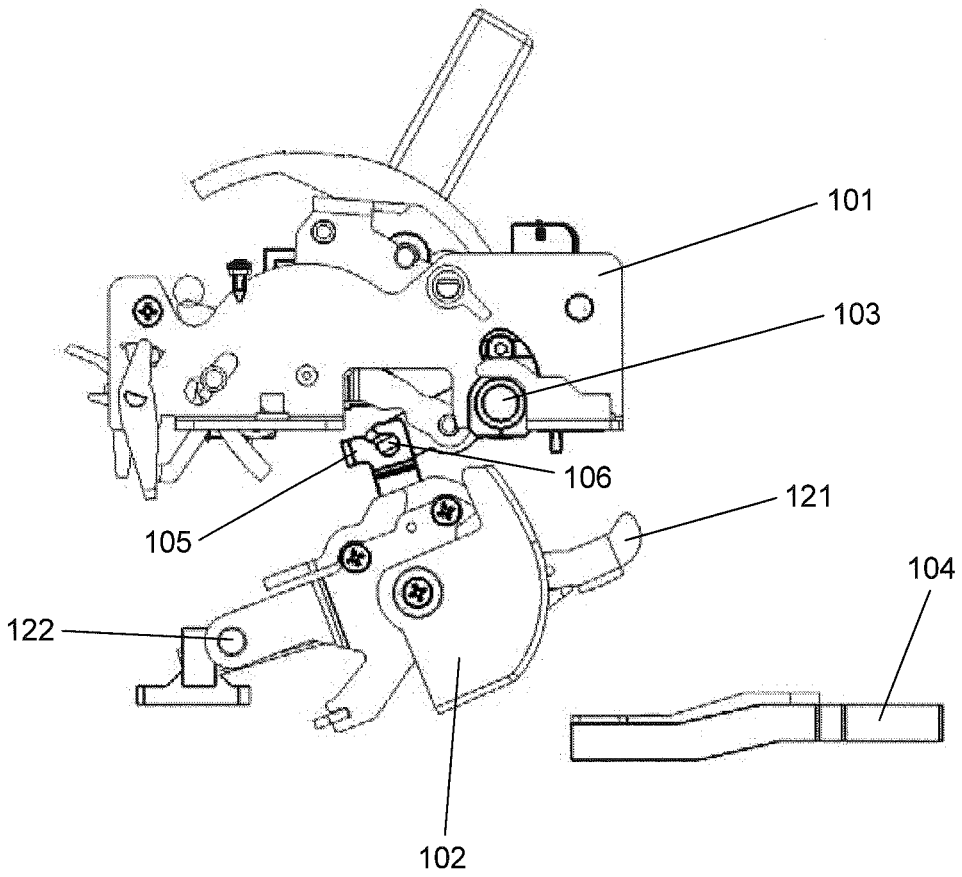
FIG. 2 illustrates the structure of a changeable operation mechanism according to an embodiment of the present invention, wherein the manual operation mechanism is used and is in an open state.
Figure 7:
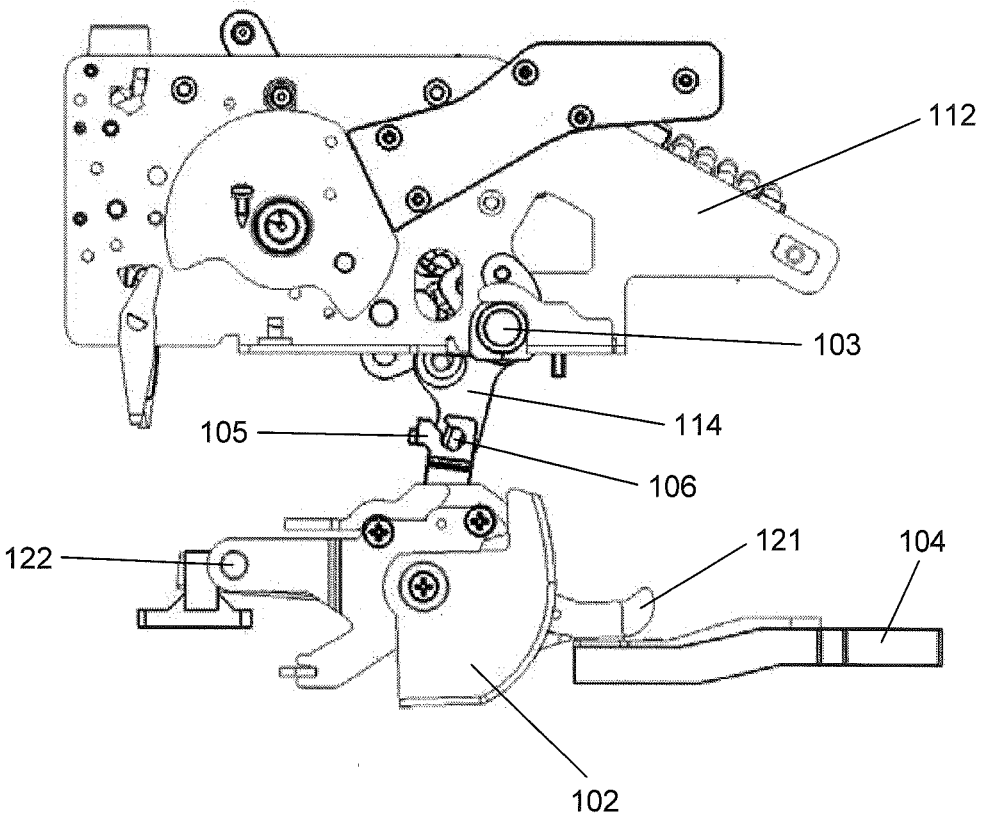
FIG. 7 illustrates the structure of a changeable operation mechanism according to an embodiment of the present invention, wherein the energy storage mechanism is used and is in a close state.

Referring to FIG. 1, FIG. 2 and FIG. 7, the changeable operation mechanism includes a contact support 102, a connecting rod 105, a connecting shaft 106, a cantilever 114 and a changeable component.

The contact support 102 is provided with a moving contact 121. The contact support 102 rotates around a shaft 122 so that the moving contact 121 is separated from or in contact with a static contact 104.

Figure 3:
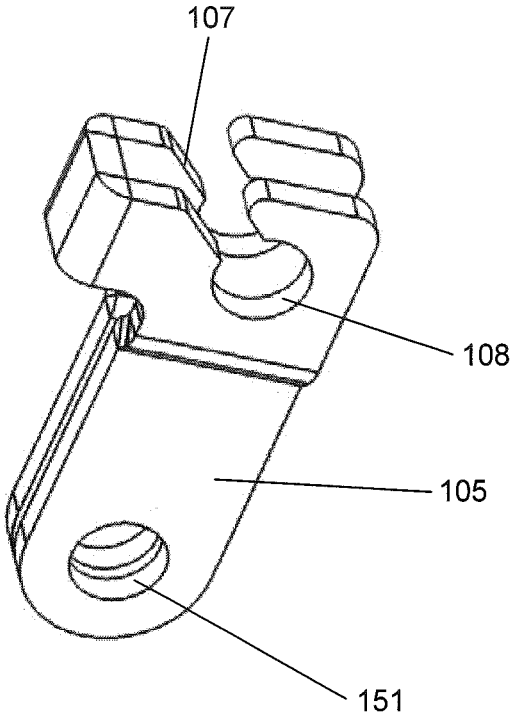
FIG. 3 illustrates the structure of a connecting rod in a changeable operation mechanism according to an embodiment of the present invention.
Figure 4:
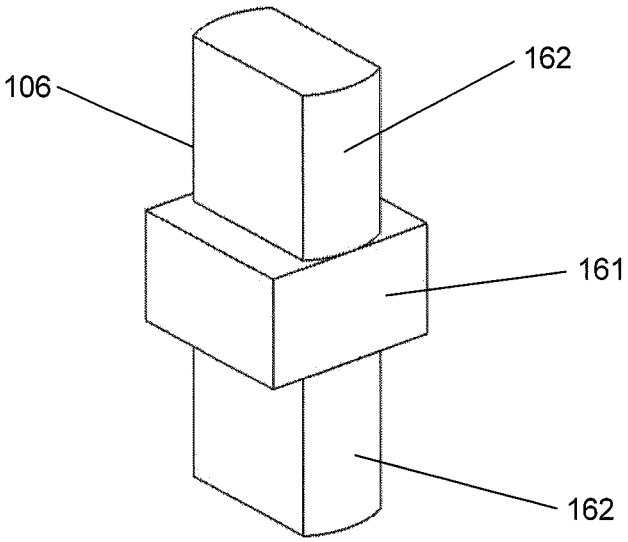
FIG. 4 illustrates the structure of a connecting shaft in a changeable operation mechanism according to an embodiment of the present invention.
Figure 5:
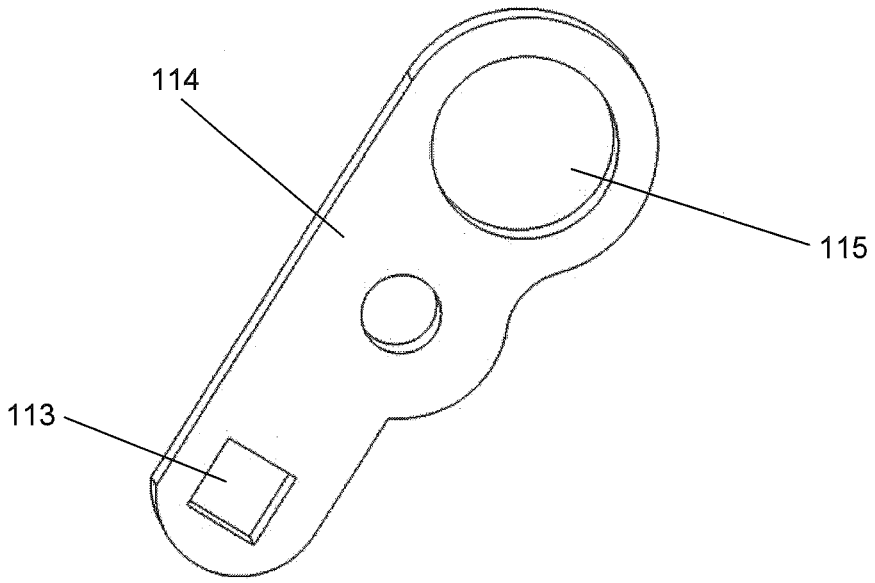
FIG. 5 illustrates the structure of a cantilever in a changeable operation mechanism according to an embodiment of the present invention.
Figure 6:
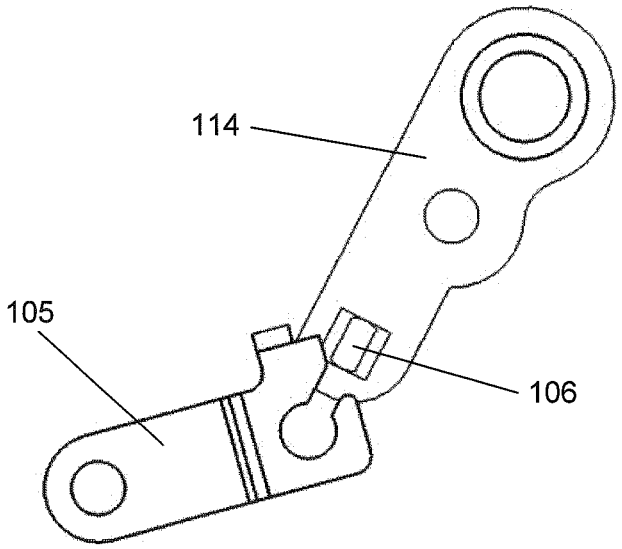
FIG. 6 illustrates the connection of a connecting rod, a connecting shaft and a cantilever in a changeable operation mechanism according to an embodiment of the present invention.

A bottom end of the connecting rod 105 is connected to the contact support 102, and a top end of the connecting rod 105 is connected to the cantilever 114 through the connecting shaft 106. FIG. 3 illustrates the structure of the connecting rod in the changeable operation mechanism according to an embodiment of the present invention. As shown in FIG. 3, the connecting rod 105 has a dual-plate structure, in which two plates are connected to each other and have a gap therebetween. The two plates have same shape and same size. Each plate has a rod hole 151 in the bottom. A shaft passes through the rod holes 151 so that the connecting rod 105 is rotatably connected to the contact support 102. On the top of each plate, there is a chute 107 and a circular hole 108. The chute 107 is connected with the circular hole 108, and the chute 107 extends to the edge of the top end of the plate. The width of the chute 107 is smaller than the diameter of the circular hole 108. FIG. 4 illustrates the structure of a connecting shaft in a changeable operation mechanism according to an embodiment of the present invention. As shown in FIG. 4, the connecting shaft 106 includes a square bar 161 in the middle and two obround bars 162 on both sides of the square bar 161. The cross-section of the obround bar 162 is obround. The width of the obround bar 162 matches with the width of the chute 107. The length of the obround bar 162 matches with the diameter of the circular hole 108, and the arc surfaces on both ends of the obround bar 162 match with the circular hole 108. The width of the square bar 161 matches with the width of the gap between the two plates of the connecting rod 105. In an implementation, the width of the obround bar 162 is a bit smaller than the width of the chute 107, so that the obround bar 162 may smoothly slide into the circular hole 108 along the chute 107 when the obround bar 162 rotates to a direction parallel to the chute 107. The length of the obround bar 162 is a bit smaller than the diameter of the circular hole 108 and the arc surfaces of the obround bar 162 are a bit smaller than the circular hole 108, so that the obround bar 162 may rotate freely within the circular hole 108. FIG. 5 illustrates the structure of a cantilever in a changeable operation mechanism according to an embodiment of the present invention. As shown in FIG. 5, the cantilever 114 is provided with a square groove 113 in the bottom and a main shaft hole 115 on the top. The shape and size of the square groove 113 match with the shape and size of the square bar 161 of the connecting shaft 106. The square bar 161 is secured in the square groove 113 so that the connecting shaft 106 is connected to the cantilever 114. The thickness of the cantilever 114 equals to the thickness of the square bar 161. The connecting shaft 106 is connected to the connecting rod 105. The cantilever 114 and the square bar 161 are embedded into the gap between two plates of the connecting rod 105. In one embodiment, the square bar 161 is inserted into the square groove 113 and is welded in the square groove 113, so that the connecting shaft 106 and the cantilever 114 are connected as a whole. FIG. 6 illustrates the connection of a connecting rod, a connecting shaft and a cantilever in a changeable operation mechanism according to an embodiment of the present invention. As shown in FIG. 6, the square bar 161 of the connecting shaft 106 is inserted into the square groove 113 and is welded in the square groove 113. The cantilever 114 is rotated to an angle so that the obround bar 162 of the connecting shaft 106 is parallel to the chute 107. The obround bar 162 slides into the circular hole 108 along the chute 107, the square bar 161 and the cantilever 114 are embedded into the gap between the two plates of the connecting rod 105. The cantilever 114 is rotated so that the obround bar 162 is no longer parallel to the chute 107. The obround bar 162 will not slide out of the circular hole 108 along the chute 107, the obround bar 162 is then be mounted into the circular hole 108 and rotates within the circular hole 108. Rotation and movement of the cantilever 114 may drive the connecting rod 105 to rotate and move through the connecting shaft 106 and the circular hole 108. It should be noted that, for the purpose of ensuring operative connection, within an operative closing stroke or an operative opening stroke, the rotation of the cantilever 114 will not let the obround bar 162 rotate to an angle which is parallel to the chute 107. So that the obround bar 162 will not slide out of the circular hole 108, that is, the connecting shaft 106 will not be separated from the connecting rod 105. In normal operation, the connecting shaft 106 and the connecting rod 105 keep connected. Only in an installation/uninstallation operation, the cantilever 114 is rotated so that the obround bar 162 is parallel to the chute 107 so as to facilitate the connection/disconnection of the connecting shaft 106 and the connecting rod 105.

The changeable component is connected to the cantilever 114 through a main shaft 103. The main shaft 103 is inserted into the main shaft hole 115 of the cantilever 114. An action of the changeable component drives the cantilever 114 to act through the main shaft 103, and further drives the contact support to act through the connecting shaft 106 and the connecting rod 105. The moving contact 121 is separated from or in contact with the static contact 104 to realize the opening or closing operation. The changeable component is a manual operation mechanism 101 or an energy storage mechanism 112. During the operations of separation or contacting of the moving contact 121 and the static contact 104, the obround bar 162 of the connecting shaft 106 is rotating within the circular hole 108. However, the rotation range of the obround bar 162 does not include the positions that make the obround bar 162 be parallel to the chute 107, so as to ensure the operative connection of the connecting shaft 106 and the connecting rod 105.

The changeable component may switch between the manual operation mechanism 101 and the energy storage mechanism 112. Both the manual operation mechanism 101 and the energy storage mechanism 112 will drive the cantilever 114 through the main shaft 103, and result in a same stroke of the action of the cantilever 114. So that the components such as the contact support 102, the connecting rod 105, the connecting shaft 106 and the cantilever 114 may be applied to both operation mechanisms.

According to the embodiment shown in FIG. 1 and FIG. 2, in this embodiment, the changeable component is the manual operation mechanism 101. The manual operation mechanism drives the cantilever 114 through the main shaft 113. During a closing operation, the connecting shaft 106 rotates anti-clockwise about the connecting rod 105. The position of the connecting shaft 106 changes from the position shown in FIG. 2 to the position shown in FIG. 1. During the closing operation, the obround bar 162 of the connecting shaft 106 will not rotate to the installation angle, which is parallel to the chute 107. So that the connecting shaft 106 will not slide out of the circular hole 108 during the operation. In one implementation, the direction of the chute 107 on the connecting rod 105 is determined bases on a rotation relationship between the connecting rod 105 and the operation mechanism, it should be ensured that the connecting rod 105 and the connecting shaft 106 will not separate in normal operation.

FIG. 7 illustrates the structure of a changeable operation mechanism according to an embodiment of the present invention. According to the embodiment shown in FIG. 7, the changeable component is the energy storage mechanism and the changeable component is in a close state. The energy storage mechanism 112 also drives the cantilever 114 through the main shaft 103, and the cantilever 114 further drives the connecting rod 105 through the connecting shaft 106. The rotation or movement of the main shaft 103 driven by the energy storage mechanism 112 are the same as that driven by the manual operation mechanism 101, so that the action procedures and action strokes of the cantilever 114, the connecting shaft 106, the connecting rod 105 and the contact support 102 are the same as that driven by the manual operation mechanism 101. The changeable ability of the manual operation mechanism 101 and the energy storage mechanism 112 is realized.

Figure 8:
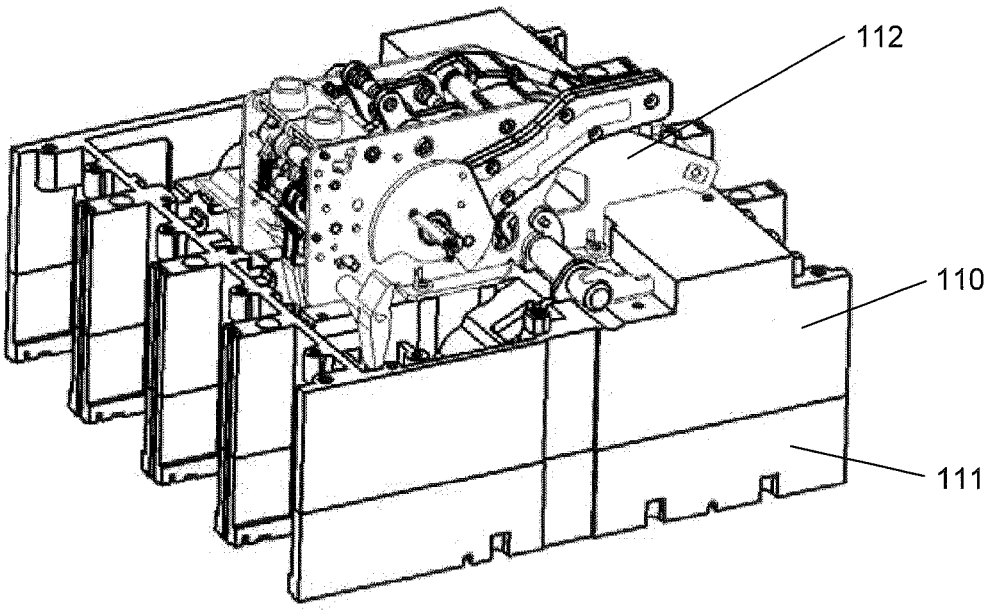
FIG. 8 illustrates an installation diagram of a changeable operation mechanism according to an embodiment of the present invention, wherein the energy storage mechanism is used.
Figure 9:
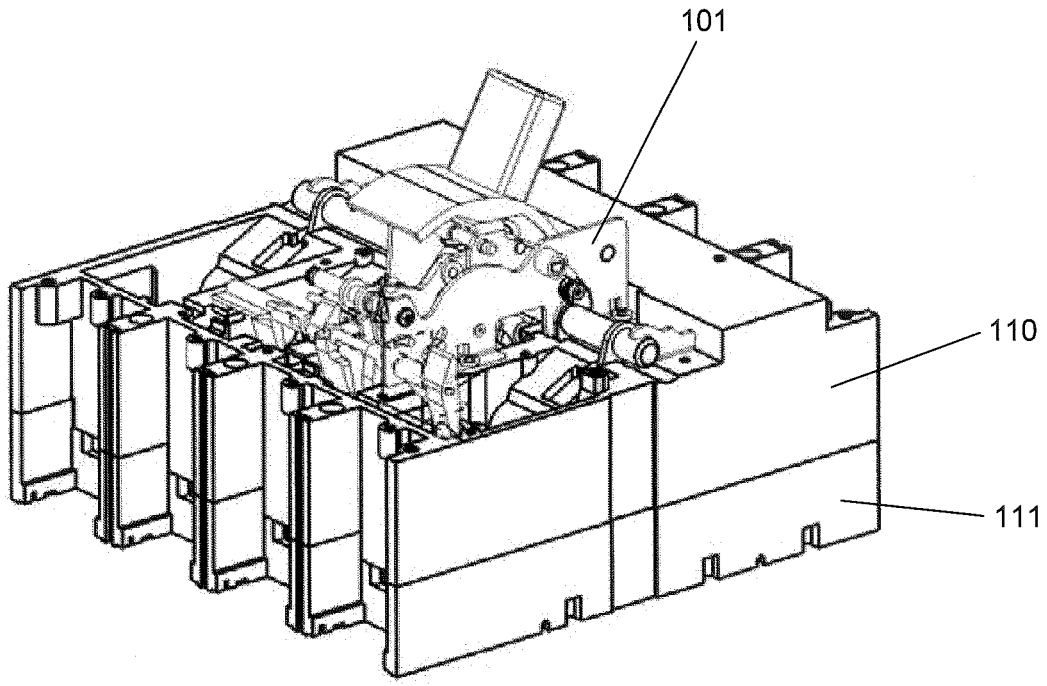
FIG. 9 illustrates an installation diagram of a changeable operation mechanism according to an embodiment of the present invention, wherein the manual operation mechanism is used.

FIG. 8 and FIG. 9 illustrate installation diagrams of a changeable operation mechanism according to an embodiment of the present invention. The changeable component shown in FIG. 8 is the energy storage mechanism and the changeable component shown in FIG. 9 is the manual operation mechanism. As shown in FIG. 8, the manual operation mechanism 101 or the energy storage mechanism 112 is mounted on a middle shell 110 of a circuit breaker base 111. When the changeable component is the energy storage mechanism 112, the energy storage motor is mounted on the circuit breaker base 111 and is disposed on the same side as the energy storage mechanism. As shown in FIG. 9, when the manual operation mechanism 101 is used, it is also mounted on the middle shell 110. The manual operation mechanism 101 and the energy storage mechanism 112 are designed to have a same profile dimension, so as to facilitate the changeable ability.

The changeable operation mechanism of the present invention may realize a convenient switch between a manual operation mechanism and an electrical operation mechanism of a MCB. When a MCB is applied in different applications, its operation mechanism may be changed between a manual operation mechanism and an electrical operation mechanism. The changeable component does not dispose the electrical operation mechanism outside the MCB, so that the height and volume of the MCB is reduced.

The above embodiments are provided to those skilled in the art to realize or use the invention, under the condition that various modifications or changes being made by those skilled in the art without departing the spirit and principle of the invention, the above embodiments may be modified and changed variously, therefore the protection scope of the invention is not limited by the above embodiments, rather, it should conform to the maximum scope of the innovative features mentioned in the Claims.

What is claimed is:

1. A changeable mechanism, comprising:

a contact support (102), provided with a moving contact (113) therein, the contact support (102) rotating about a shaft (122) to make the moving contact (113) be separated from or in contact with a static contact (104);

a connecting rod (105), a bottom end of the connecting rod (105) being connected to the contact support (102), a top end of the connecting rod (105) being connected to a cantilever (114) through a connecting shaft (106), wherein the connecting rod (105) has a dual-plate structure, in which two plates are connected to each other and have a gap therebetween, each plate has a rod hole (151) in a bottom, a shaft passes through the rod holes (151) so that the connecting rod (105) is rotatably connected to the contact support (102), wherein on top of each plate there is a chute, and the chute extends to an edge of a top end of the respective plate a changeable component connected to the cantilever (114) through a main shaft (103), wherein the changeable component acts and drives the cantilever (114) to act through the main shall (103), and further drives the contact support (102) to rotate through the connecting shaft (106) and the connecting rod (105), the rotation of the contact support (102) makes the moving contact (113) and the static contact (104) to be separated from or in contact with each other so as to realize opening or closing of a circuit breaker, wherein the changeable component is a manual operation mechanism (101) or an energy storage mechanism (112).

2. The changeable mechanism according to claim 1, wherein the two plates of the connecting rod (105) have same shape and same size, wherein on the top of each plate there is a circular hole (108), the chute (107) is connected with the circular hole (108), the width of the chute (107) is smaller than a diameter of the circular hole (108).

3. The changeable mechanism according to claim 2, wherein the connecting shaft (106) includes a square bar (161) in a middle portion and two obround bars (162) on two sides of the square bar (161), a cross-section of each of the two obround bars is obround, a width of each of the two obround bars matches with the width of the chute (107), a length of each of the two obround bars (162) matches with the diameter of the circular hole (108), and arc surfaces on ends of each of the two obround bars couple with the circular hole (108), a width of the square bar (161) matches with the width of the gap between the two plates of the connecting rod (105).

4. The changeable mechanism according to claim 3, wherein the top end of the connecting rod (105) is connected to the connecting shaft (106), the connecting shaft (106) rotates to make the two obround bars (162) be parallel to the chute (107) and slide along the chute (107) into a corresponding circular hole (108), the connecting shaft (106) rotates to make the obround bars (162) be not parallel to the chute (107) and the two obround bars (162) are mounted within a corresponding circular hole (108) and are able to rotate therein.

5. The changeable mechanism according to claim 4, wherein the cantilever (114) is provided with a square groove (113) in a bottom portion and a main shaft hole (115) on a top portion, a shape and size of the square groove (113) match with a shape and size of the square bar (161) of the connecting shaft (106), the square bar (161) is secured in the square groove (113) so that the connecting shaft (106) is connected to the cantilever (114), a thickness of the cantilever (114) equals to a thickness of the square bar (161), the connecting shaft (106) is connected to the connecting rod (105), the cantilever (114) and the square bar (161) are embedded into the gap between two plates of the connecting rod (105).

6. The changeable mechanism according to claim 4, wherein the contact support (102) rotates to make the moving contact (113) and the static contact (114) be separated from or in contact with each other, one of the two obround bars (162) of the connecting shaft (106) rotates within the circular hole (108), wherein a rotation range of the rotated obround bar (162) does not include positions that will make the rotated obround bar (162) be parallel to the chute (107).

7. The changeable mechanism according to claim 1, wherein an action stroke of the cantilever (114) driven by the manual operation mechanism (101) through the main shaft (103), and an action stroke of the cantilever (114) driven by the energy storage mechanism (112) through the main shaft (103) are the same.

8. The changeable mechanism according to claim 7, wherein the manual operation mechanism (101) or the energy storage mechanism (112) are mounted on a middle shell (110) of a circuit breaker base (111).

9. The changeable mechanism according to claim 8, wherein the changeable component is the energy storage mechanism (112), and an energy storage motor is mounted on the circuit breaker base (111) and is disposed on a same side as the energy storage mechanism (112).

10. A changeable mechanism, comprising:

a contact support (102), provided with a moving contact (113) therein, the contact support (102) rotating about a shaft (122) to make the moving contact (113) be separated from or in contact with a static contact (104);

a connecting rod (105), a bottom end of the connecting rod (105) being connected to the contact support (102), a top end of the connecting rod (105) being connected to a cantilever (114) through a connecting shaft (106);

a changeable component connected to the cantilever (114) through a main shaft (103), wherein the changeable component acts and drives the cantilever (114) to act through the main shaft (103), and further drives the contact support (102) to rotate through the connecting shaft (106) and the connecting rod (105), the rotation of the contact support (102) makes the moving contact (113) and the static contact (104) to be separated from or in contact with each other so as to realize opening or closing of a circuit breaker, wherein the changeable component is a manual operation mechanism (101) or an energy storage mechanism (112)

wherein the connecting rod (105) has a dual-plate structure, in which two plates are connected to each other and have a gap therebetween, the two plates have a same shape and a same size, each plate has a rod hole (151) in the bottom end, a shaft passes through each rod hole (151) so that the connecting rod (105) is rotatably connected to the contact support 102, on the top of each plate of the two plates, there is a chute (107) and a circular hole (108), the chute (107) is connected with the circular hole (108) and the chute (107) extends to the edge of the top end of the plate, the width of the chute (107) is smaller than a diameter of the circular hole (108).

11. The changeable mechanism according to claim 10, wherein the connecting shaft (106) includes a square bar (161) in a middle portion and two obround bars (162) on two sides of the square bar (161), a cross-section of each of the two obround bars is obround, a width of each of the two obround bars matches with the width of the chute (107), a length of each of the two obround bars (162) matches with the diameter of the circular hole (108), and arc surfaces on ends of each of the two obround bars couple with the circular hole (108), a width of the square bar (161) matches with the width of the gap between the two plates of the connecting rod (105).

12. The changeable mechanism according to claim 11, wherein the top end of the connecting rod (105) is connected to the connecting shaft (106), the connecting shaft (106) rotates to make the two obround bars (162) be parallel to the chute (107) and slide along the chute (107) into a corresponding circular hole (108), the connecting shaft (106) rotates to make the two obround bars (162) be not parallel to the chute (107) and the obround bars (162) are mounted within a corresponding circular hole (108) and are able to rotate therein.

13. The changeable mechanism according to claim 12, wherein the cantilever (114) is provided with a square groove (113) in a bottom and a main shaft hole (115) on a top, a shape and size of the square groove (113) match with the shape and size of the square bar (161) of the connecting shaft (106), the square bar (161) is secured in the square groove (113) so that the connecting shaft (106) is connected to the cantilever (114), a thickness of the cantilever (114) equals to a thickness of the square bar (161), the connecting shaft (106) is connected to the connecting rod (105), the cantilever (114) and the square bar (161) are embedded into the gap between two plates of the connecting rod (105).

14. The changeable mechanism according to claim 12, wherein the contact support (102) rotates to make the moving contact (113) and the static contact (114) be separated from or in contact with each other, one of the two obround bars (162) of the connecting shaft (106) rotates within the circular hole (108), wherein a rotation range of the rotated obround bar (162) does not include positions that will make the rotated obround bar (162) be parallel to the chute (107).

15. The changeable mechanism according to claim 10, wherein an action stroke of the cantilever (114) driven by the manual operation mechanism (101) through the main shaft (103), and an action stroke of the cantilever (114) driven by the energy storage mechanism (112) through the main shaft (103) are the same.

16. The changeable mechanism according to claim 15, wherein the manual operation mechanism (101) or the energy storage mechanism (112) are mounted on a middle shell (110) of a circuit breaker base (111).

17. The changeable mechanism according to claim 16, wherein the changeable component is the energy storage mechanism (112), and an energy storage motor is mounted on the circuit breaker base (111) and is disposed on a same side as the energy storage mechanism (112).

* * * * *